US010239072B2

(12) United States Patent
Scaife et al.

(10) Patent No.: US 10,239,072 B2
(45) Date of Patent: Mar. 26, 2019

(54) ENERGY DISSIPATION UNIT FOR HIGH VOLTAGE CHARGED PAINT SYSTEM

(71) Applicant: Honda Motor Co., Ltd., Tokyo (JP)

(72) Inventors: Graham Scaife, Innisfil (CA); Koji Shido, Tochigi (JP); Masashi Honma, Bangkok (TH); Norihiko Sudo, Tochigi (JP)

(73) Assignee: Honda Motor Co. Ltd., Tokyo (JP)

( * ) Notice: Subject to any disclaimer, the term of this patent is extended or adjusted under 35 U.S.C. 154(b) by 106 days.

(21) Appl. No.: 15/262,390

(22) Filed: Sep. 12, 2016

(65) Prior Publication Data

US 2017/0080439 A1 Mar. 23, 2017

Related U.S. Application Data

(60) Provisional application No. 62/221,792, filed on Sep. 22, 2015.

(51) Int. Cl.

*B05B 5/00* (2006.01)
*B05B 5/16* (2006.01)
*B05B 5/043* (2006.01)

(52) U.S. Cl.

CPC ..... *B05B 5/1608* (2013.01); *B05B 5/043* (2013.01)

(58) Field of Classification Search

CPC ..... B05B 5/0255; B05B 5/0533; B05B 5/025; B05B 5/1625; B05B 5/1616
USPC ..... 239/3, 690–708
See application file for complete search history.

(56) References Cited

U.S. PATENT DOCUMENTS 3,599,038 A * 8/1971 Skidmore ..... B05B 5/035 118/621
3,770,205 A * 11/1973 Proctor ..... A01C 23/042 239/317
3,971,337 A * 7/1976 Hastings ..... B05B 5/1608 118/629
5,199,650 A * 4/1993 Ishibashi ..... B05B 5/1625 239/690
5,310,120 A * 5/1994 Ehinger ..... B05B 5/1608 118/629
5,335,854 A * 8/1994 Seitz ..... B05B 5/1608 118/300
5,364,035 A * 11/1994 Ma ..... B05B 5/1641 239/112
5,765,761 A * 6/1998 Law ..... B05B 5/03 239/690.1
6,935,583 B2 * 8/2005 Mauchle ..... B05B 5/032 239/600

(Continued)

*Primary Examiner* — Viet Le
(74) *Attorney, Agent, or Firm* — Honda Patents & Technologies North America, LLC; Mark E. Duell

(57) ABSTRACT

A grounding dissipation unit for a paint delivery apparatus for delivering paint is disclosed. The paint delivery apparatus includes a first paint line for carrying paint from a canister, a second paint line for carrying paint to an ionizing applicator for electrically charging paint, a first water line for carrying water to a grounding source, a second water line carrying water to the grounding dissipation unit, and a third water line for carrying water to a dump. The grounding dissipation unit includes a core made of an electrically conductive material. A paint bore in the core connects the paint lines, and a water bore in the core connects to the water lines to ground the system. The paint bore and water bore do no intersect within the core.

20 Claims, 10 Drawing Sheets

(56) References Cited

U.S. PATENT DOCUMENTS

| | | | | |
|---|---|---|---|---|
| 7,617,997 | B2 * | 11/2009 | Nagai | B05B 5/0407 118/620 |
| 7,748,651 | B2 * | 7/2010 | Amari | B05B 5/03 239/290 |
| 7,828,527 | B2 * | 11/2010 | Smith | B05B 9/0423 417/26 |
| 7,836,846 | B2 * | 11/2010 | Mikalsen | B05B 5/1608 118/621 |
| 7,914,686 | B2 * | 3/2011 | Yono | C02F 1/465 204/263 |
| 8,225,740 | B2 * | 7/2012 | Mitsui | B05B 5/1625 118/323 |
| 8,434,702 | B2 * | 5/2013 | Mori | B05B 5/053 239/302 |
| 2009/0224083 | A1 * | 9/2009 | Baltz | B05B 5/03 239/692 |
| 2012/0240851 | A1 * | 9/2012 | Murata | B05B 5/0535 118/663 |
| 2014/0263694 | A1 * | 9/2014 | Lin | A01K 67/033 239/3 |
| 2015/0238986 | A1 * | 8/2015 | Hasselschwert | B05B 5/0255 239/3 |

* cited by examiner

ENERGY DISSIPATION UNIT FOR HIGH VOLTAGE CHARGED PAINT SYSTEM

RELATED APPLICATION

This application claims priority from U.S. provisional patent application Ser. No. 62/221,792 filed on Sep. 22, 2015, which is incorporated by reference herein in its entirety.

BACKGROUND

An electrostatic paint spray system is a highly efficient technology for the application of paint to specific work pieces. Negatively charged atomized paint particles and a grounded work piece create an electrostatic field that draws the paint particle to the work piece, minimizing overspray.

For this technology, an ionizing electrode, typically located at the paint gun atomizer tip, causes paint particles to pick up additional electrons and become negatively charged. As the coating is deposited on the work piece, the charge dissipates through the ground and returns to the power supply, completing the circuit. The electrostatic field influences the path of the paint particles. Because the charged particles are attracted to the grounded workpiece, overspray is significantly reduced. Paint particles that pass a workpiece can be attracted to and deposited on the back of the piece.

The transfer efficiency is the percent of sprayed paint that is applied to the workpiece. Paint that is not applied to a work piece is captured in the paint spray booth's emission control system and ultimately disposed as waste. The typical transfer efficiency for an electrostatic paint spray systems is 75%.

A potential drawback to electrostatic finishing, particularly for coating complicated surfaces, is the Faraday cage effect: a tendency for charged coating particles to deposit around entrances of cavities. The Faraday cage effect allows electric charges on a conductor to reside on the outer surface of the conductor. In the case of coating complicated surfaces, the electric charge resides on the entrances of cavities. High particle momentum can help overcome Faraday cage effects, since particles with greater momentum (larger particles or particles traveling at higher speeds) are influenced less by the electrostatic forces. However, high particle momentum also lowers efficiency.

Electrostatic paint equipment is available in three basic types: air atomized, airless, and rotating discs and bells. High-speed discs atomize the coating more finely than air atomization and direct more paint to the target. This technology is particularly efficient for the application of difficult to disperse, high-solids paints. However, the Faraday cage effect is generally greater with rotary atomizers than with air or airless types. Rotary atomizers, therefore, may not provide adequate coverage for complicated surfaces.

Electrostatic paint spray systems operate at high voltages (30 to 150 kV). Typical operation is to allow the system to go unused in order to dissipate energy prior to docking the applicator for paint refill, which extends the life of the valves in the paint gun. To more quickly dissipate energy in the system, it is necessary to provide a grounding dissipation unit in the system, preferably near the energized paint. All items in the work area must be grounded, including the operators, the paint booth, the application equipment (unless applying conductive coatings), and conveyors. Ungrounded items should be removed from the work area.

APPLICATION SUMMARY

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

According to one aspect, a grounding dissipation unit for a paint delivery apparatus for delivering paint is disclosed. The paint delivery apparatus includes a first paint line for carrying paint from a canister, a second paint line for carrying paint to an ionizing applicator for electrically charging paint, a first water line for carrying water to a grounding source, a second water line carrying water to the grounding dissipation unit, and a third water line for carrying water to a dump. The grounding dissipation unit includes a core comprising an electrically conductive material, a paint bore in the core having a paint inlet and a paint outlet. The first paint line is connected to the paint inlet for carrying paint to the grounding dissipation unit and the second paint line is connected to the paint outlet for carrying paint away from the grounding dissipation unit. A water bore in the core has a water inlet and a water outlet. The second water line is connected to the water inlet for carrying water to the grounding dissipation unit and the third water line is connected to the water outlet for carrying water away from the grounding dissipation unit to a dump. The paint bore and water bore do no intersect within the core.

According to another aspect, a method of grounding a paint delivery apparatus for delivering paint is disclosed. The paint delivery apparatus includes a first paint line for carrying paint from a canister, a second paint line for carrying paint to an ionizing applicator for electrically charging paint, a first water line for carrying water to a grounding source, a second water line for carrying water to the grounding dissipation unit, and a third water line for carrying water to a dump. The method includes the steps of providing a grounding dissipation unit having a core comprising an electrically conductive material, a paint bore in the core having a paint inlet and a paint outlet, and wherein the first paint line is connected to the paint inlet for carrying paint to the grounding dissipation unit and the second paint line is connected to the paint outlet for carrying paint away from the grounding dissipation unit, a water bore in the core having a water inlet and a water outlet, the second water line is connected to the water inlet for carrying water to the grounding dissipation unit and the third water line is connected to the water outlet for carrying water away from the grounding dissipation unit to the dump. Water is run from a water source through the first water line to the grounding source, through the second water line to the core of the grounding dissipation unit, through the water bore, and through the third water line to the dump, wherein the water provide a grounding pathway from the grounding dissipation unit to the grounding source. The grounding dissipation unit and the paint delivery apparatus are grounded as water runs through the first, second, and third water lines and the grounding dissipation unit.

According to yet another aspect, a grounding dissipation unit includes a first line carrying an electrostatic liquid to the grounding dissipation unit, a second line carrying the electrostatic liquid away from the grounding dissipation unit, a first water line for carrying water from grounding source, a second water line for carrying water to a dump, a core comprising an electrically conductive material, a bore in the core having a first inlet and a second outlet, wherein a first line is connected to the first inlet and the second line is connected to the second outlet, a water bore in the core having a water inlet and a water outlet, the first water line is connected to the water inlet and the second water line is connected to the water outlet, and wherein the bore and water bore do not intersect within the core.

The figures depict various embodiments of the embodiments for purposes of illustration only. One skilled in the art will readily recognize from the following discussion that alternative embodiments of the structures and methods illustrated herein may be employed without departing from the principles of the embodiments described herein.

DETAILED DESCRIPTION

Figure 1:
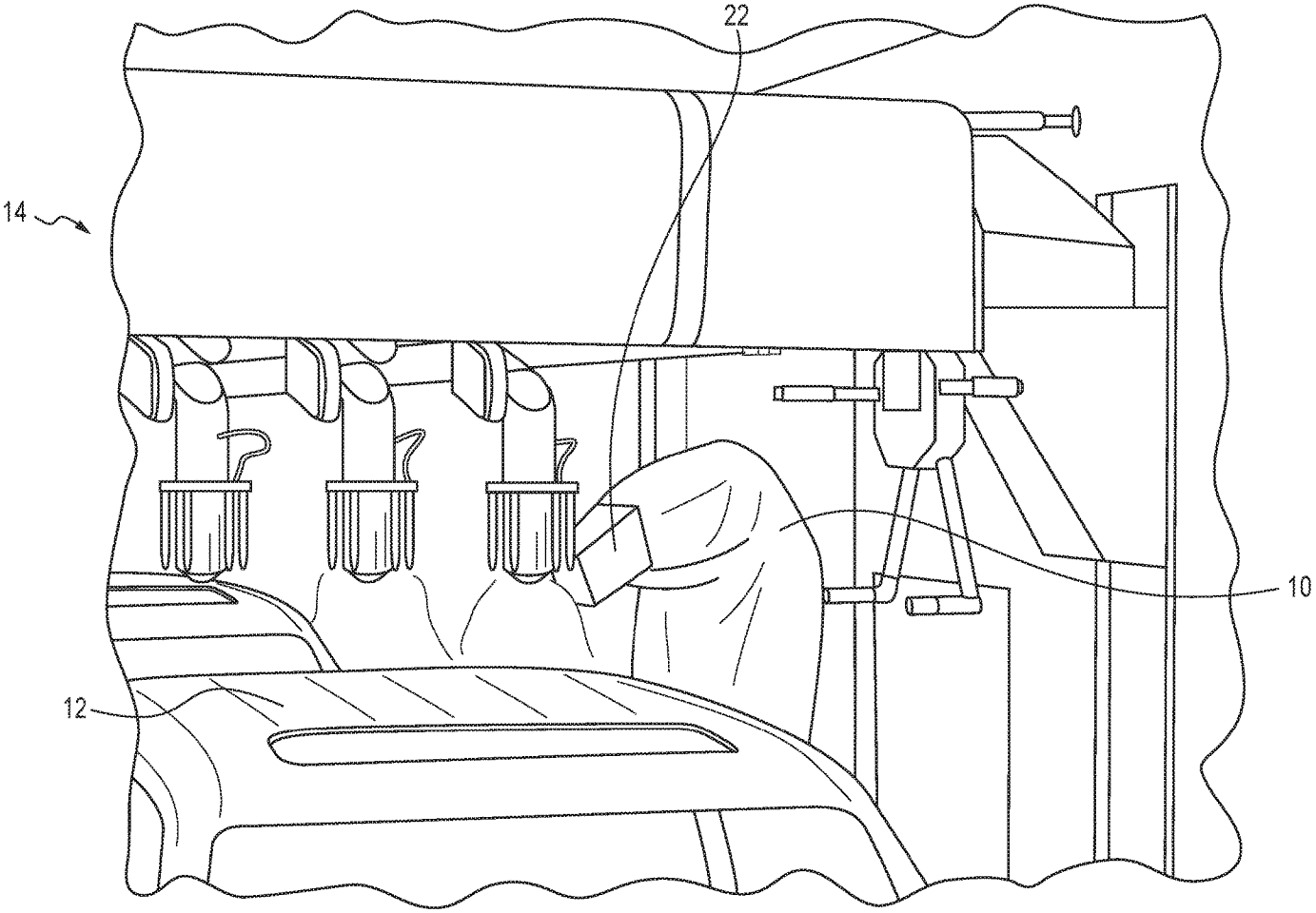
FIG. 1 is an embodiment of a paint delivery system for delivering electrically charged or electrostatic paint to a work piece.

FIG. 1 shows a paint delivery system 10 for delivering an electrostatic liquid, such as electrically charged or electrostatic paint, to a work piece 12, such as a vehicle body or vehicle component. The work piece 12 travels down a conveyor belt towards a paint booth 14, where it is sprayed with electrostatically charged paint particles. The paint particles are charged typically by an ionizing electrode 20, shown in FIG. 2, typically located at the paint gun applicator 22, causes paint particles to pick up additional electrons and become negatively charged. As the coating is deposited on the work piece 12, the charge dissipates through the ground and returns to the power supply, completing the circuit. After the workpiece 12 is coated, it continues on the conveyor belt to an oven, where the paint is cured.

Everything in the area of the electrostatic paint delivery system 10 must be grounded to prevent static buildup and arcing, which can damage the hanging devices and/or the locations where the hanging devices rest on the conveyor. All hangers, conveyors, etc. must be cleaned often to ensure a good ground and prevent anyone in the area from getting a severe shock. Also, the paint delivery system 10 must be grounded prior to docking the applicator 22 before the paint delivery system's 10 paint canisters are refilled or changed out for a color change.

Figure 2:
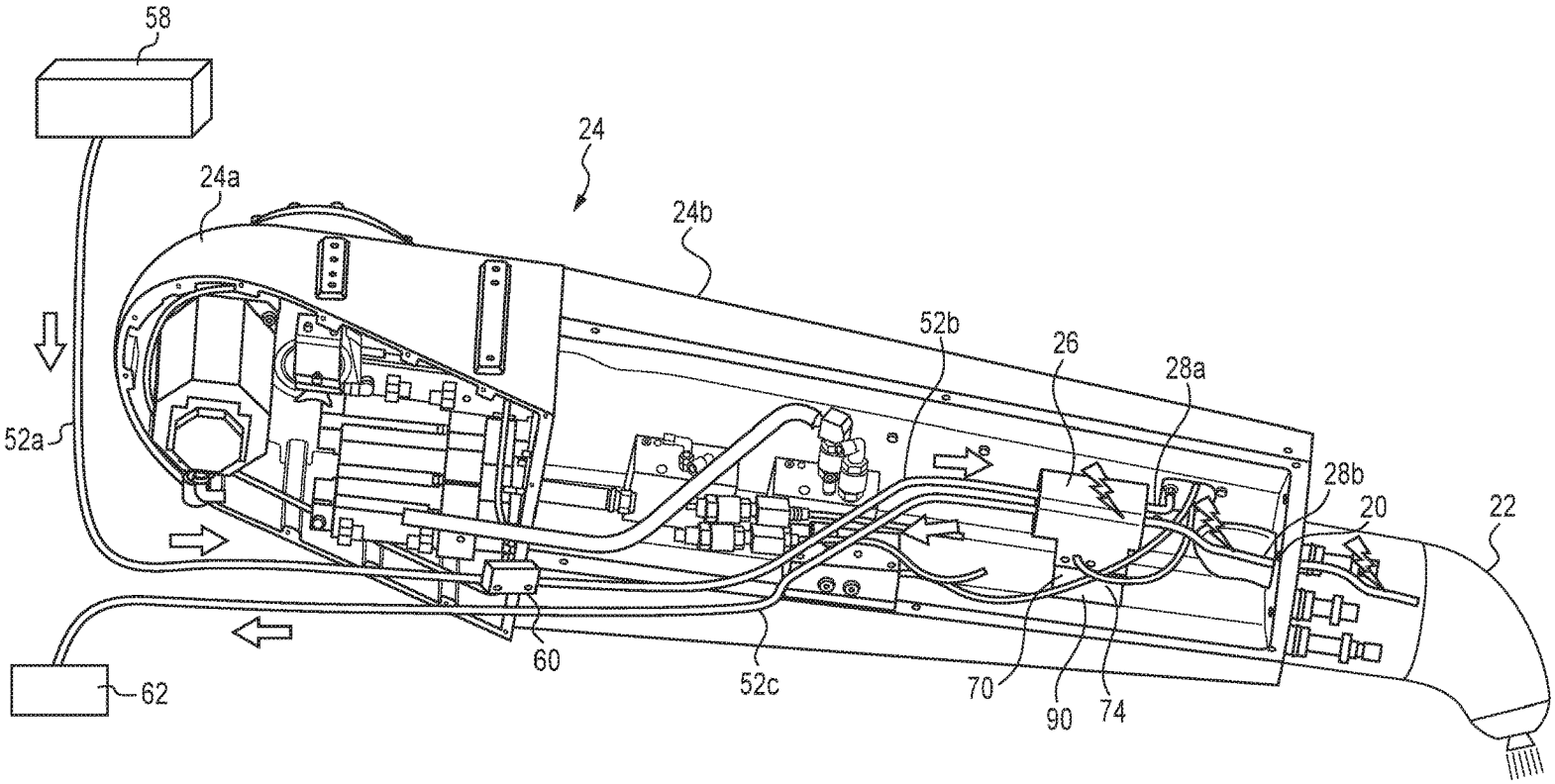
FIG. 2 is an embodiment of a grounding dissipation unit on the robot arm of a paint delivery system.

FIG. 2 shows an embodiment of a grounding dissipation unit 26 on the robot arm 24 of a paint delivery system 10. The robot arm 24 includes a metal portion 24*a* and a non-conducting polymer portion 24*b*. The grounding dissipation unit 26 is preferably mounted directly on the robot arm 24 in the polymer portion 24*b* of the paint delivery system 10. The grounding dissipation unit 26 is able to, when engaged, ground the paint line 28*a*, 28*b* between the ionizing electrode 20 in the applicator 22 and the paint canister.

Figure 3:
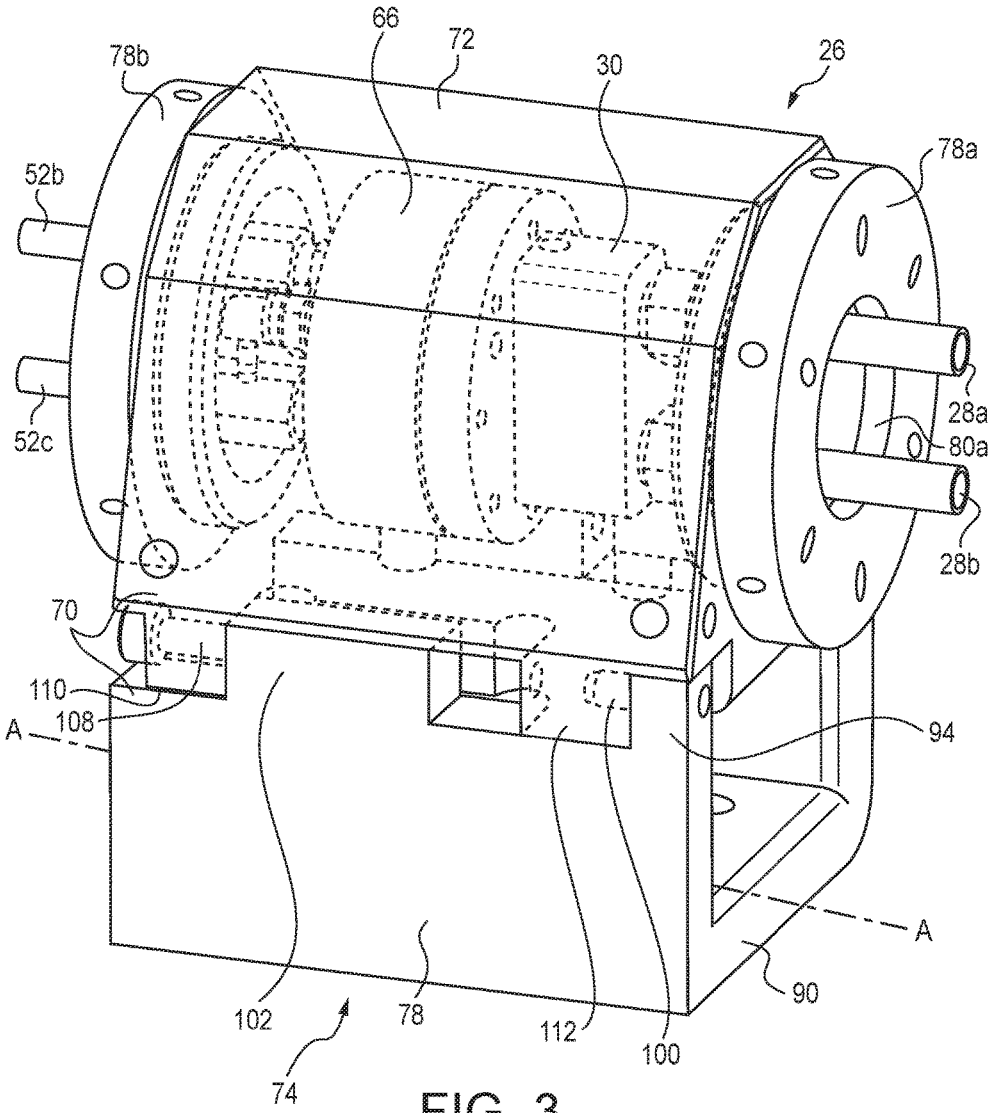
FIG. 3 is an embodiment of the grounding dissipation unit.
Figure 4:
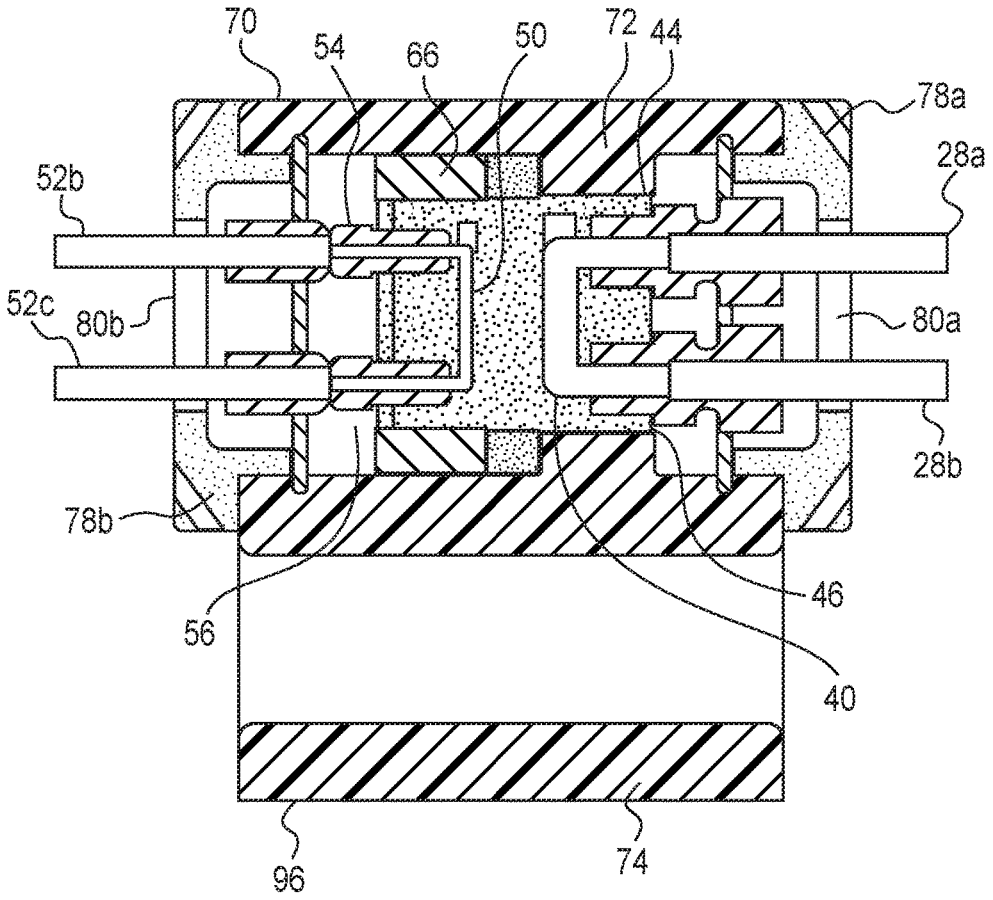
FIG. 4 is an cross-section of FIG. 3 along A-A.

FIGS. 3 and 4 show an embodiment of the grounding dissipation unit 26. The grounding dissipation unit 26 includes a core 30 made of an electrically conductive material. The core 30 has two U-shaped bores 40, 50 formed inside. The first bore is a paint bore 40. A first paint line 28*a* is connected to an inlet 44 of the paint bore 40, and a second paint line 28*b* is connected to an outlet 46 of the paint bore 40. The first paint line 28*a* is connected to the paint canister and receives paint from the canister. The second paint line 28*b* feeds paint to the ionizing electrode 20. The first paint line 28*a*, the inlet 44, the paint bore 40, the outlet 46, and the second paint line 28*b* all form a continuous pathway for paint to flow from the canister to the ionizing electrode 20.

The core 30 also includes a water bore 50. A first water line 52*a* is connected to an inlet 54 of the water bore 50, and a second water line 52*b* is connected to an outlet 56 of the water bore 50. The first water line 52*a* is connected to a water source 58 and transports water from the water source 58 to the grounding point 60. A second water line 52*b* then transports from the grounding point 60 to the core 30. A third water line 52*c* transports water away from the core 30 to be disposed in a dump 62, as illustrated in FIG. 2.

The grounding dissipation unit 26 operates by conducting electric charge from the paint line 28*a*, 28*b* through the electrically conductive core 30 to water flowing through the water lines 52*b* and the core 30, to a grounding source 60 when the water is flowing. Operation of the grounding dissipation unit 26 allows the voltage in the paint lines 28*a*, 28*b* to be safely dissipated prior to the ionizing electrode 20 from being docked for cleaning or the paint canister being replaced or refilled.

Figure 5:
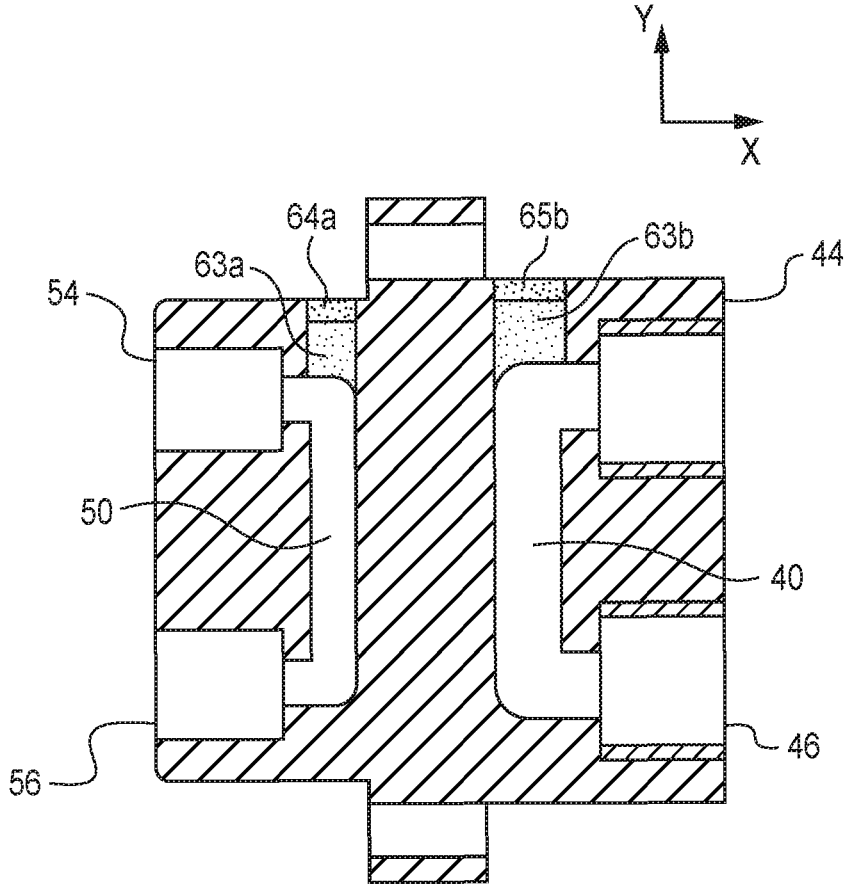
FIG. 5 is an embodiment of a core of the grounding dissipation unit.

The core 30 of the grounding dissipation unit 26 is made of an electrically conductive material, preferably stainless steel. Each of the bores 40, 50 may be created in any suitable manner known to those of ordinary skill in the art. One method, as shown in FIG. 5, shows the inlets 44, 54 and outlets 46, 56 have been bored in by a tool (not shown, but on the type known to those skilled in the art), in the direction of the x-axis, and the remainder of the bore created by a tool boring into the core in the direction of the y-axis. After boring the U-shaped paint bore 40 and water bore 50, the excess holes 63*a*, 63*b* along the y-axis may be filled by plug welds 64*a*, 64*b* in a manner known to those of ordinary skill in the art.

Figure 6:
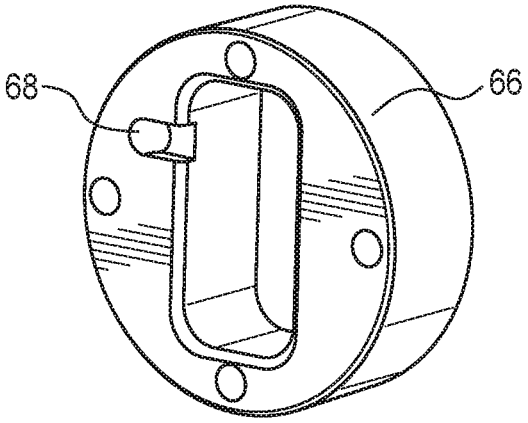
FIG. 6 is an embodiment of the purge puck.
Figure 7:
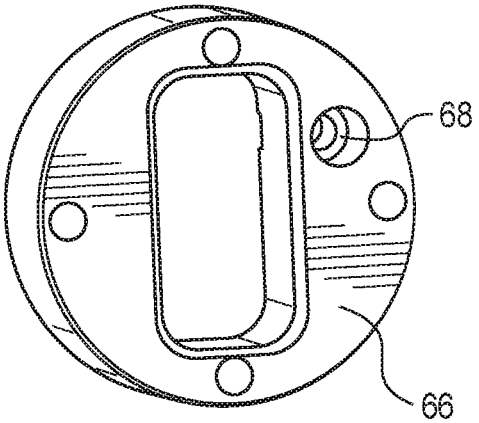
FIG. 7 is an embodiment of the purge puck.
Figure 8A:
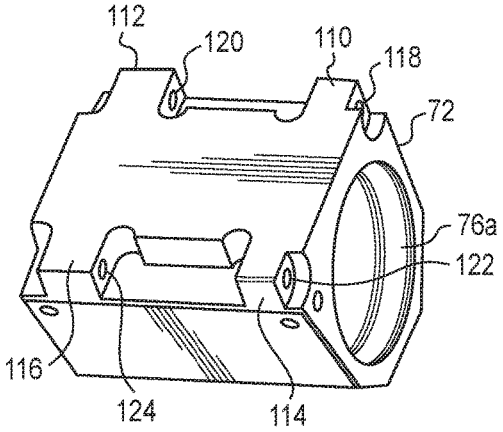
FIGS. 8*a*, 8*b*, 8*c*, and 8*d* are an embodiment of the top of the housing of the grounding dissipation unit.
Figure 8B:
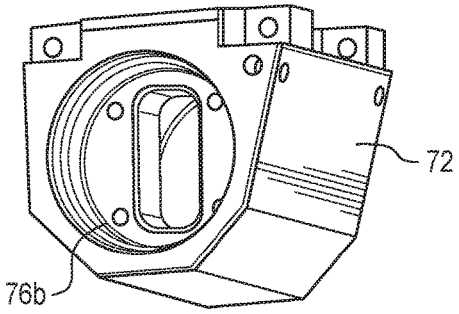
Figure 8C:
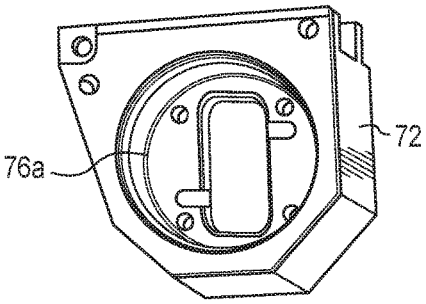
Figure 8D:
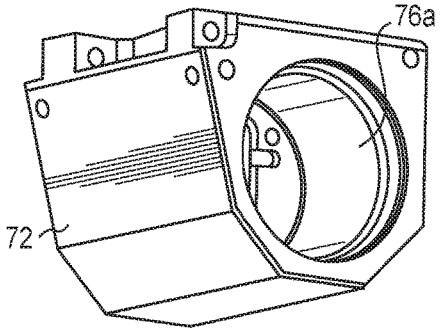

As shown in FIG. 4, which is a central cross section of the FIG. 3 along line A-A, the grounding dissipation unit 26 may include a purge puck 66 that surrounds the core 30 within a housing 70. FIGS. 6 and 7 show close up views of the purge puck 66. The purge puck 66 is preferably made of a plastic with specific isolation thicknesses to provide isolation of the core 30 from any other parts to ensure proper operation, as well as to control airflow through the grounding dissipation unit 26. In the embodiment shown, the purge puck 66 is made of the thermoplastic polyoxymethylene, also known as POM, acetal, polyacetal, and polyformaldehyde, and sold under the names Delrin, Celcon, Ramtal, Duracon, Kepital, and Hostaform. The purge puck 66 includes a vent slot 68 that allows purge air to move through the grounding dissipation unit 26, which allows the purge air to push out any ozone that may build up in the electrically charged environment around the core 30.

As shown in FIGS. 3, 4, and 8*a*, 8*b*, 8*c*, and 8*d*, the core 30 and purge puck 66 sit on and within a housing 70. Preferably, the housing includes a top 72 and a base 74. The top 72 of the housing 70 is designed to securely receive the core 30 and the purge puck 66. The top 72 of the housing has open ends 76*a*, 76*b* along the longitudinal direction and is solid material, preferably plastic, in the lateral directions for protecting the core 30. On each longitudinal end of the top 72 of the housing 70, the housing 70 receive first and second caps 78*a*, 78*b* that have open centers 80*a*, 80*b* that allow the first and second paint lines 28*a*, 28*b* and first and second water lines 52*a*, 52*b* to exit the housing 70.

Figure 9A:
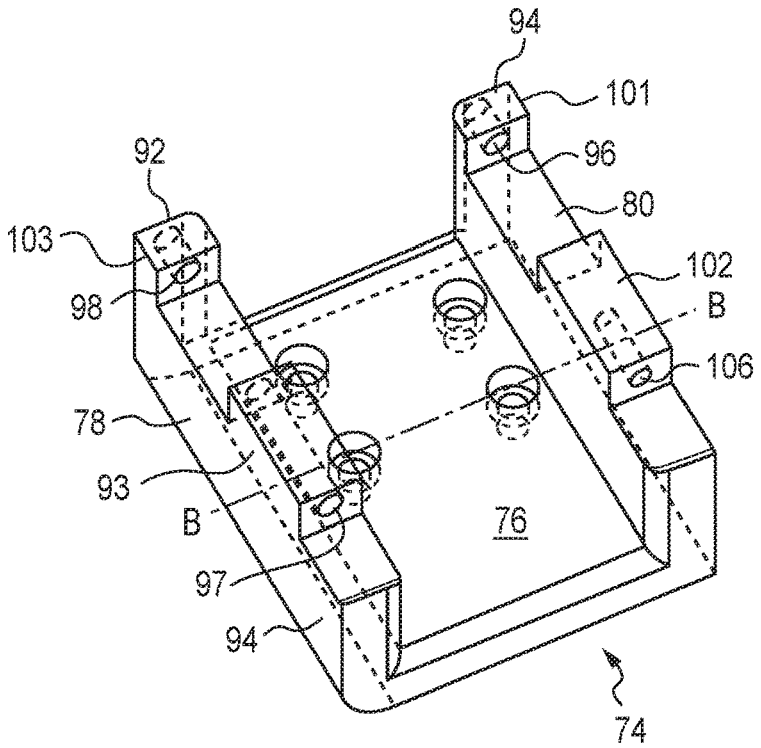
FIG. 9*a* is an embodiment of the base of the housing of the grounding dissipation unit.
Figure 9B:
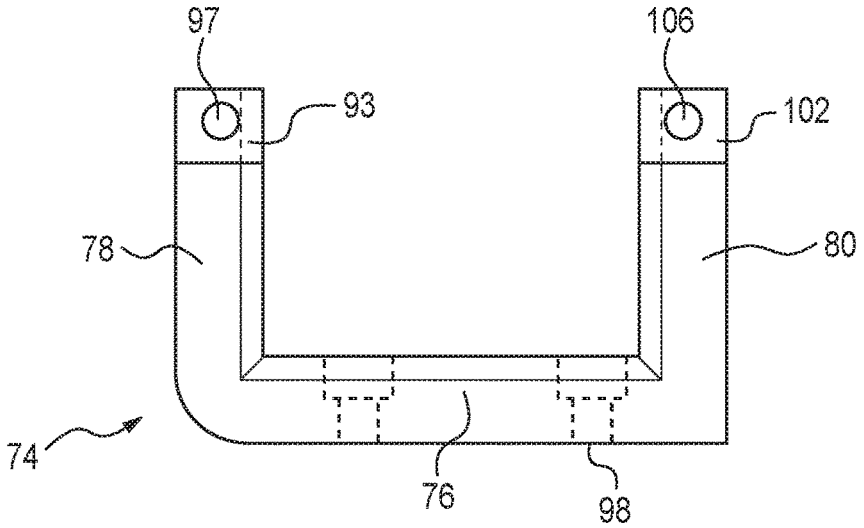
FIG. 9*b* is a cross-section of FIG. 9*a* along line B-B.

The housing also includes a base 74, also preferably made of plastic, and is preferably a separate part from the top 72 of the housing 70. An embodiment of the base 74 is shown in FIGS. 2, 3, 4, 9*a*, and 9*b*. As shown in FIG. 9*b*, which is a cross section B-B of FIG. 9*a*, the base 74 generally has a U-shaped cross section having a bottom portion 76 and two upwardly extending side portions 78, 80. The bottom portion 76 of the base 74 is attached to the polymer portion 24*b* of the robot arm 24. The top 72 of the housing 70 is removably attached to three upwardly extending portions 92, 93, 94 extending from the side portions 78, 80. These upwardly extending portions 92, 93, 94 include with holes 96, 97. 98 for receiving pins 100 and one additional upwardly extending expanded projections 102. The upwardly extending expanded projection 102 has a threaded hole 106 for receiving a bolt 108. The top 72 is secured to the base 74 by creating an interlocking fit between the upwardly extending projections 92, 93, 94 and upwardly extending expanded projection 102 on the base 74, and downwardly extending projections 110, 112, 114, 116 on the top 72 which also have holes 118, 120, 122, 124. The top 72 is then slid so the holes 118, 120, 124 in the downwardly extending projections 110, 112, 116 on the top receive the pins 100 extending from the upwardly extending portions 92, 93, 94 of the base 74 creating an interference fit. Finally, a bolt 108 is threaded through hole in the downwardly extending projection 118 of the top 72 an into the threaded hole 106 in the upwardly extending expanded projection 102 on the base 74 to securely fit the top 72 to the base 74. By removing the bolt 108, the top 72 can then be slid to disengage the top 72 from the pins 100, thereby allowing the top 72 of the housing 70 and core 30 to be replaced. Replacement may be necessitated by a desire to change paint lines 28*a*, 28*b* or to replace the core 30 for performance.

In the embodiment shown, the housing top 72 and housing base 74 are made of the thermoplastic polyoxymethylene, also known as POM, acetal, polyacetal, and polyformaldehyde, and sold under the names Delrin, Celcon, Ramtal, Duracon, Kepital, and Hostaform. However, the housing top 72 and housing base 74 may be made of any other suitable non-conducting material known to one skilled in the art.

Figure 10:
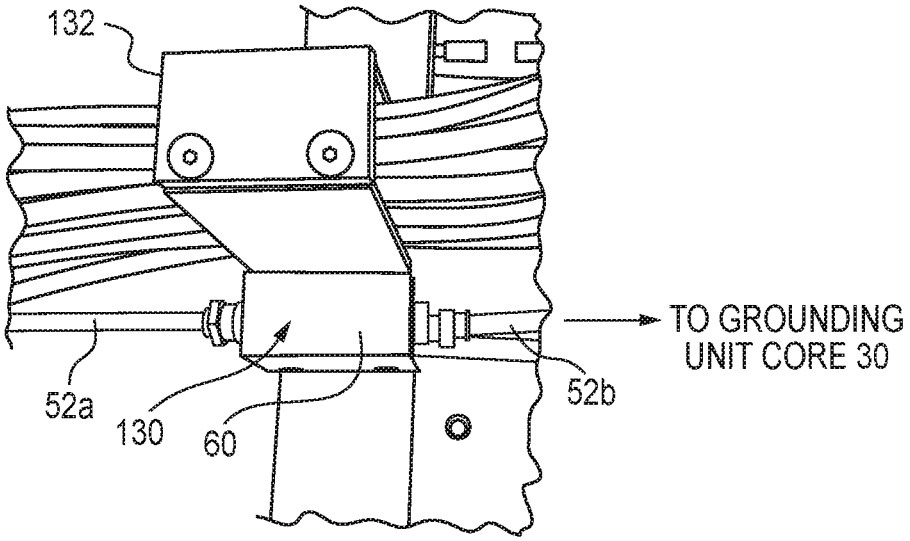
FIG. 10 is an embodiment of a manifold at the grounding point of the paint delivery system.
Figure 11:
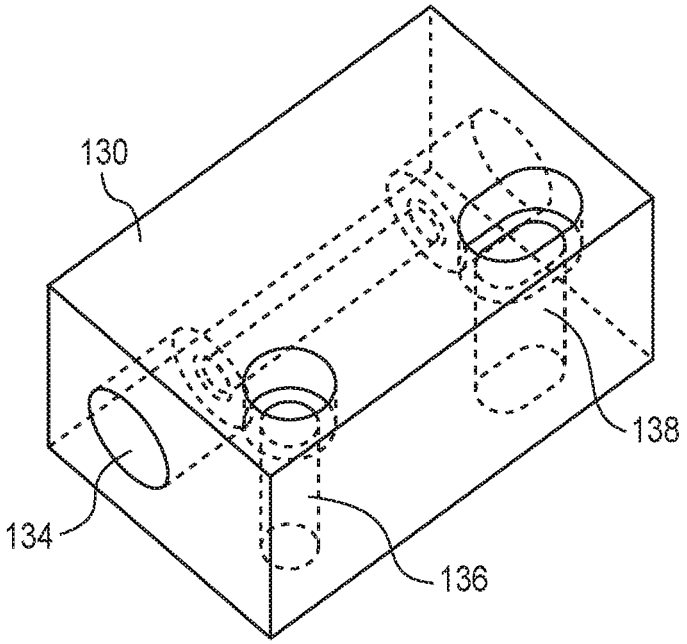
FIG. 11 is an embodiment of the manifold at the grounding point of the paint delivery system.

As shown in FIG. 10, the first water line 52*a* runs to a manifold 130 mounted to a tubing clamp assembly 132 on the metallic portion 24*a* of the robot arm 24. The manifold 130 is grounded at this location and provides the grounding point 60 for the electrostatic paint delivery system 10. The manifold 130, as shown in FIG. 11, has a bore 134 therethrough in a longitudinal direction, into which the second water line is attached. Water runs though the bore and into a second water line 52*b*, which takes the water to the core 30 of the grounding dissipation unit 26. A third water line 52*c* takes the water to the dump 62. In the embodiment shown, additional bores 136, 138 are located in a lateral direction for connecting the manifold 130 to the tubing clamp assembly 132. Any suitable attachment method for the manifold 130 and method of grounding to one of skill in the art may be used.

Reference in the specification to "one embodiment" or to "an embodiment" means that a particular feature, structure, or characteristic described in connection with the embodiments is included in at least one embodiment. The appearances of the phrase "in one embodiment" or "an embodiment" in various places in the specification are not necessarily all referring to the same embodiment.

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments, which is set forth in the claims.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses of the embodiments without departing from the spirit and scope of the embodiments as defined in the appended claims.

What is claimed is:

1. A grounding dissipation unit for a paint delivery apparatus for delivering paint, the paint delivery apparatus including a first paint line for carrying paint from a canister, and a second paint line for carrying paint to an ionizing applicator for electrically charging paint, comprising:

a grounding source;

a first water line for carrying water to the grounding source;

a second water line carrying water to the grounding dissipation unit;

a third water line for carrying water to a dump; and a core comprising an electrically conductive material, the core further comprising;

a paint bore in the core having a paint inlet and a paint outlet, wherein the first paint line is connected to the paint inlet for carrying paint to the grounding dissipation unit and the second paint line is connected to the paint outlet for carrying paint away from the grounding dissipation unit;

a water bore in the core having a water inlet and a water outlet, the second water line is connected to the grounding source and to the water inlet for carrying water to the grounding dissipation unit and the third water line is connected to the water outlet for carrying water away from the grounding dissipation unit to a dump; and wherein the paint bore and water bore do not intersect within the core.

2. The grounding dissipation unit of claim 1 wherein the electrically conductive material is stainless steel.

3. The grounding dissipation unit of claim 1 further comprising:

a housing, said housing comprising:

a top for holding the core, the housing having a slot for purging ozone gas from the grounding dissipation unit; and a base fixedly attached to the paint delivery apparatus, said top being removably secured to the base.

4. The grounding dissipation unit of claim 3 wherein the core further comprises:

a purge puck providing additional separation between a portion of the core and the housing, the purge puck having a notch corresponding to the slot in the housing, the purge puck comprised of a non-conducting material.

5. The grounding dissipation unit of claim 4 wherein the non-conduction material is a thermoplastic.

6. The grounding dissipation unit of claim 5 wherein the thermoplastic is polyoxymethylene.

7. The grounding dissipation unit of claim 3 wherein the housing is comprised of a non-conducting material.

8. The grounding dissipation unit of claim 7 wherein the non-conduction material is a thermoplastic.

9. The grounding dissipation unit of claim 8 wherein the thermoplastic is polyoxymethylene.

10. The grounding dissipation unit of claim 1 wherein the grounding source comprises:

a manifold connected to the grounding source and having a bore, an inlet, and an outlet;

wherein the first water line is connected to the inlet of the manifold; and wherein the second water line is connected to the outlet of the manifold for providing a pathway to ground the grounding dissipation unit.

11. The grounding dissipation unit of claim 3 wherein the top is removably secured to the base by three lateral pins and a bolt.

12. A method of grounding a paint delivery apparatus for delivering paint, the paint delivery apparatus including a first paint line for carrying paint from a canister, a second paint line for carrying paint to an ionizing applicator for electrically charging paint, a first water line for carrying water to a grounding source, a second water line for carrying water to the grounding dissipation unit, and a third water line for carrying water to a dump, comprising the steps of:

providing a grounding dissipation unit having a core comprising an electrically conductive material, a paint bore in the core having a paint inlet and a paint outlet, wherein the first paint line is connected to the paint inlet for carrying paint to the grounding dissipation unit and the second paint line is connected to the paint outlet for carrying paint away from the grounding dissipation unit, a water bore in the core having a water inlet and a water outlet, the second water line is connected to the water inlet for carrying water to the grounding dissipation unit and the third water line is connected to the water outlet for carrying water away from the grounding dissipation unit to the dump;

running water from a water source through the first water line to the grounding source, through the second water line to the core of the grounding dissipation unit, through the water bore, and through the third water line to the dump, wherein the water provide a grounding pathway from the grounding dissipation unit to the grounding source; and grounding the grounding dissipation unit and the paint delivery apparatus as water runs through the first, second, and third water lines and the grounding dissipation unit.

13. The method of claim 12, further comprising the steps of:

disconnecting the second and third water lines and the first and second paint lines from the core;

removing the core and a housing top surrounding the core;

replacing the core and the housing top with a replacement core and housing top;

reconnecting the second and third water lines and the first and second paint lines to the replacement core.

14. A grounding dissipation unit, comprising a first line carrying an electrostatic liquid to the grounding dissipation unit;

a second line carrying the electrostatic liquid away from the grounding dissipation unit;

a first water line for carrying water from a grounding source;

a second water line for carrying water to a dump;

a core comprising an electrically conductive material;

a bore in the core having a first inlet and a second outlet, wherein a first line is connected to the first inlet and the second line is connected to the second outlet;

a water bore in the core having a water inlet and a water outlet, the first water line is connected to the water inlet and the second water line is connected to the water outlet;

wherein the bore and water bore do not intersect within the core, and wherein the water flowing from the grounding source through the first water line to the grounding dissipation unit provides a grounding path between the grounding dissipation unit and the grounding source.

15. The grounding dissipation unit of claim 14 wherein the electrically conductive material is stainless steel.

16. The grounding dissipation unit of claim 15 further comprising:

a housing, said housing comprising:

a top for holding the core, the housing having a slot for purging ozone gas from the grounding dissipation unit; and a base, said top being removably secured to the base.

17. The grounding dissipation unit of claim 16 wherein the core further comprises:

a purge puck providing additional separation between a portion of the core and the housing, the purge puck having a notch corresponding to the slot in the housing, the purge puck comprised of a non-conducting material.

18. The grounding dissipation unit of claim 17 wherein the housing is comprised of a non-conducting material.

19. The grounding dissipation unit of claim 18 wherein the non-conduction material is a thermoplastic.

20. The grounding dissipation unit of claim 19 wherein the thermoplastic is polyoxymethylene.

* * * * *